United States Patent [19]

Belokin, Jr.

[11] 3,964,189

[45] June 22, 1976

[54] ADVERTISING DISPLAY

[76] Inventor: Paul Belokin, Jr., Rte. 4, Hayward, Wis. 54843

[22] Filed: Sept. 8, 1975

[21] Appl. No.: 611,237

Related U.S. Application Data

[63] Continuation-in-part of Ser. No. 507,711, Sept. 20, 1974, abandoned.

[52] U.S. Cl. ..... 40/33; 40/128; 40/139; 46/47; 272/8 D

[51] Int. Cl.[2] ..... G09F 19/10

[58] Field of Search ..... 40/33, 128, 139, 37, 40/138, 39, 40, 126 R, 126 B, 77, 106.3; 272/8 D; 46/47, 243 M, 243 AV, 137, 140

[56] References Cited

UNITED STATES PATENTS

| | | | |
|---|---|---|---|
| 1,976,093 | 10/1934 | Raymond | 40/138 X |
| 2,214,410 | 9/1940 | Evans | 40/33 |
| 3,031,784 | 5/1962 | Stein | 40/33 X |
| 3,231,995 | 2/1966 | Anthony | 40/33 X |
| 3,284,935 | 11/1966 | Kutschmende | 40/33 |

FOREIGN PATENTS OR APPLICATIONS

| | | | |
|---|---|---|---|
| 714,756 | 8/1965 | Canada | 40/33 |
| 840,950 | 6/1952 | Germany | 40/139 |
| 995,531 | 4/1964 | United Kingdom | 40/33 |

*Primary Examiner*—John F. Pitrelli
*Attorney, Agent, or Firm*—Watson D. Harbaugh

[57] ABSTRACT

An animated display suspended for rotation about a vertical axis carries a motor and power source that rotates a depending ribbon preferably of varying area and cross-sectional weight about a second axis eccentric to and preferably inclined to the vertical axis to attract attention for advertising in providing the illusion of a natural pouring stream of liquid, such as a beverage from a bottle as accelerated by gravity, with light reflective surfaces and coloring that adds to the illusion of the beverage expected from the bottle.

12 Claims, 6 Drawing Figures

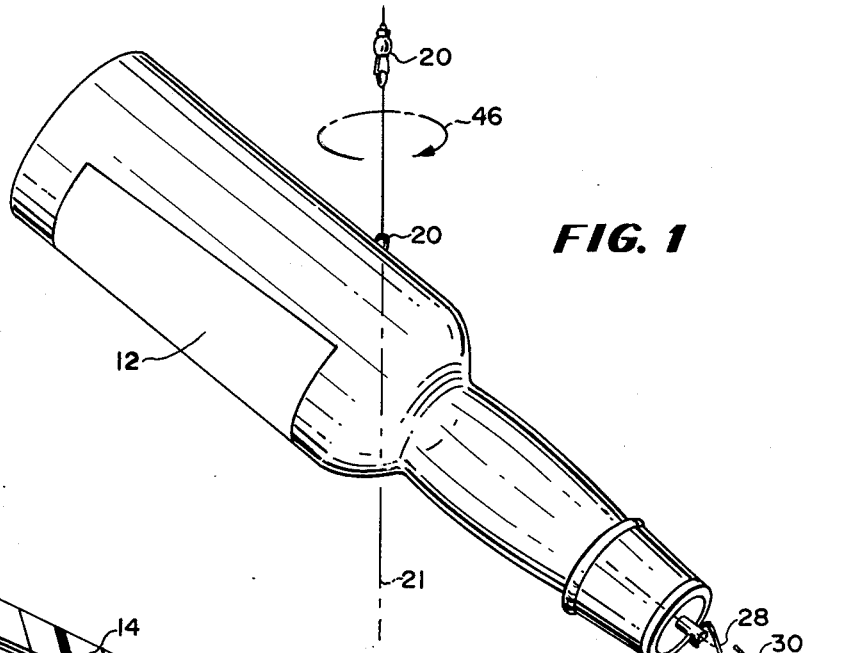
FIG. 1
FIG. 2
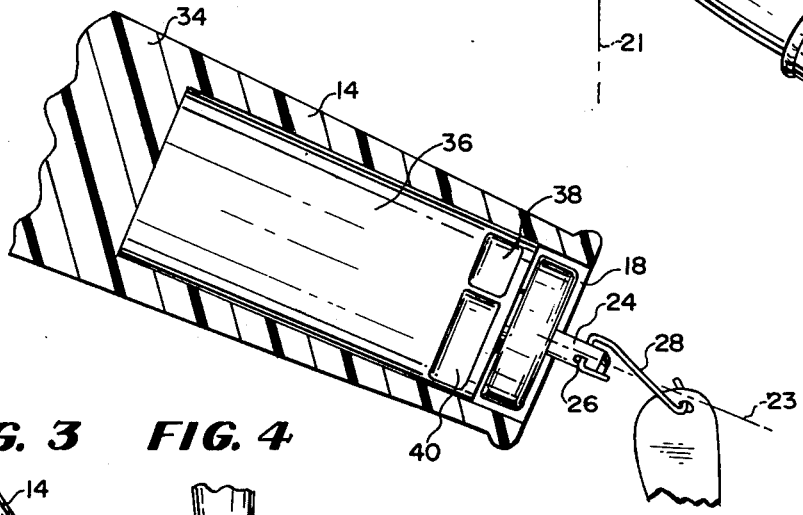
FIG. 3
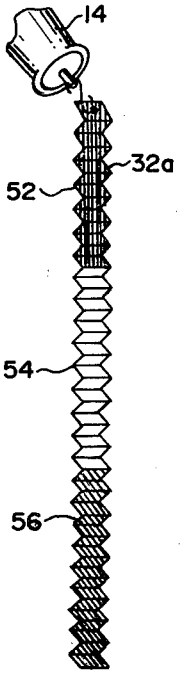
FIG. 4
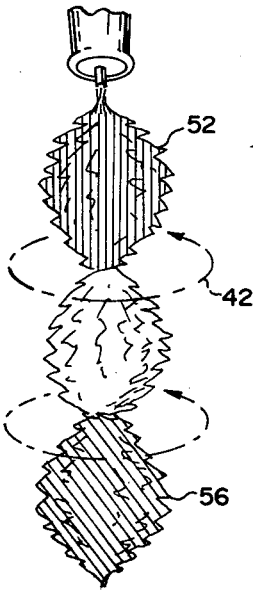
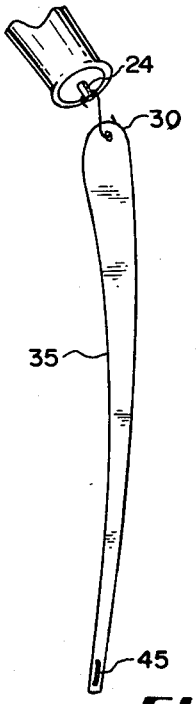
FIG. 5
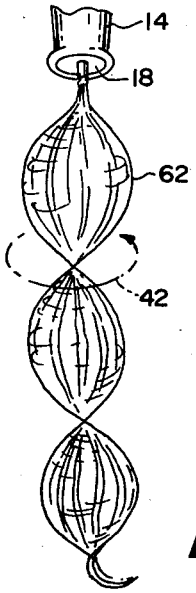
FIG. 6

ADVERTISING DISPLAY

This application is a continuation-in-part of Ser. No. 507,711, filed Sept. 20, 1974, now abandoned.

BACKGROUND OF THE INVENTION

Motorized advertising displays and illusions are well known in the art from rotated spirally striped barber poles with illusional rising of the stripes, to coaxial elements supported on a swivel and counter-rotated by the torque reaction of a motor between them, and including concealment of the motor in one of the elements. Such elements are rigidly formed, or are of flexible strips which result in unnatural nodular configurations when confined to twist about a vertical axis, or have a uniform diameter throughout their length, or both. None provides the progressive reduction of diameter of a poured stream of liquid as it progressively reduces in its diameter as with the descending stream being accelerated by gravity.

Moreover, where earlier efforts have generally been confined to fixed axes of rotation, lateral movement or gyration of the axis of rotation is desirable to provide animation that depicts mobility and directional flexibility that are recognized suggestively with pouring a beverage successively into several glasses.

It has been noted that when the sides of a twisting tape are substantially straight and the tape is comparatively narrow throughout its length even the slightest friction at the swivel may unduly retard the induced bodily rotation of the bottle, the narrower the strip the less rotation and the broader the ribbon the greater the twisting and shortening of the overall length of the ribbon with a corresponding loss of the illusion of the pouring of a liquid. Thus, the illusionary diameter of the stream of liquid becomes greater than the diameter of the neck of the bottle.

Also, it has been noted heretofore that the diameter illusion appears to increase towards the lower end at speeds of rotation low enough to provide the illusion of flowing liquid, and, the imageries induced are vertically spaced enlargements of flow which is more attention getting than realistic for pouring liquids.

SUMMARY OF THE INVENTION

The invention contemplates swivel-mounting an article such as a bottle, from above or below, on a vertical axis and rotating it with an eccentrically disposed depending ribbon which provides an illusion of a pouring liquid with a progressively displaced flow and color effects suggestive of particular liquids.

It has been discovered that a construction in which the upper end of the ribbon is gradually enlarged from a narrow lower end and the ribbon when planar is geometrically arched in a way similar to the cross-sectional shape of an airplane wing with the support hole provided at the large end off center towards the arching side of the section, the streamer when rotated takes the shape of a tapering flow which exists with a true liquid flow because of the natural reduction of stream due to normal acceleration by gravity. Moreover, the illusion of poured liquid is augmented by a slight weight at the narrow lower end of ribbons such as one or two wire stitches normally used to hold papers together. Not only does it elongate the illusionary flowing stream but in combination with the increased ribbon area exposed at the top to the air on one side compared with that on the other side of the axes of rotation when off center or eccentric to the axis of the induced bottle rotation, the air movement impelling area of the ribbon is greater on one side of the axis of rotation than on the other side. Thereby, the bottle is positively rotated on its swivel with sufficient movement that the lower end of the ribbon swings outwardly enough to provide the further illusion of the poured stream curving in a way natural to the action of a stream poured in a direction that is inclined from the vertical and subjected to acceleration of gravity.

DESCRIPTION OF THE DRAWINGS

Referring to the drawings, a specific embodiment of the invention is shown wherein:

FIG. 1 is a perspective view of a bottle carrying and a rotating ribbon which simulates a stream of liquid flowing therefrom under gravity acceleration;

FIG. 2 is a fragmentary cross-section of the neck of the bottle to show the hidden motor drive;

FIG. 3 is a fragmentary view showing a corrugated or folded form of ribbon having different colored bands thereon;

FIG. 4 is a view illustrating the ribbon of FIG. 3 in motion;

FIG. 5 is a fragmentary view showing the planar shape of the ribbon that is attached to the drive shaft of the motor in FIG. 1; and FIG. 6 is a view illustrating a flat ribbon with substantially parallel sides in nodulated motion provides the illusion of vertically spaced glittering balls.

DESCRIPTION OF THE PREFERRED EMBODIMENT

Referring to FIG. 1, the object on display comprises a bottle 10 bearing the label 12 and having its neck portion 14 with a recess or passageway 16 therein forming a housing for a motor 18. The bottle 10 can be a molded plastic bottle simulating the shape, color and appearance of a wine or whiskey bottle of a known manufacturer or producer of the product.

Preferably the bottle is supported from above. For this purpose a swivel mount 20 is suitably attached to the exterior of the bottle as by an adhesive, at a point of balance whereby the bottle assumes a pouring position, it being appreciated that the bottle can be supported as shown with the neck 14 below the swivel mount 20. The wire 22 attaches from the swivel mount 20 to a stationary support to determine a vertical axis 21. The drive shaft of the motor 18 is illustrated at 24 extending slightly from the recess 16. Referring to FIG. 2, the shaft 24 has a transfer bore 26 therethrough near its end to receive one part of an S-shaped wire hook 28 to provide a short coupling at the bottle opening. The other end of the hook 29 is received within the hole 30 of the thin flexible ribbon 32 of thin flat material and determines a second axis 23 inclined to the first axis 21.

The bottle 10 may be an ordinary glass bottle as used to contain a liquid product or a bottle formed of foamed plastic in which event the body 34 can be solid and suitably weighted for desired orientation of the axes. The recess 16 defines a compartment for the batteries 36 to run the motor. The terminals 38 and 40 from the battery make contact with the motor on being engaged when the motor device is inserted into the recess 16. As shown in FIG. 1, when the motor is actuated, the shaft 24 rotates the hook 28 which in turn rotates the ribbon 32 in any selected direction one of which is shown by the arrow 42.

Although the ribbon 32 may have parallel substantially straight sides 31 (FIG. 3) and be either flat or folded, it is preferred that they taper towards each other (FIG. 5) from the top to the bottom and preferably be curved in a plane to a radial depth 35 intermediate the ends approximately the width of ribbon 32 at the top where the mounting hole 30 at the top is eccentrically disposed. The extra width on one side of the hole 30 at this level provides adequate effort to rotate the bottle against possible friction at the swivel by eccentrically presenting a major width of the ribbon area at the top so that this larger area portion as it is turned provides a directional force on the environmental air when passing through an arc greater than 180° remote from the vertical axis that is dominant over the lesser force present in an arc less than 180° when passing between the two axes 21 and 23 of the motor and bottle rotations. Moreover, the offset provides the differential and controls the speed of the motor rotation with an adequate load while also serving as an air foil area which leads the ribbon to spiral with the width of the ribbon as related to the eccentricity of the hole in the air to provide a taper illusion of gravity induced flow acceleration. In association weight 45 at the lower end of the ribbon elongates the spiral and prevents flutter of the lower end thereof, the weight 45, area 33 and eccentricity of the hole 30 being functionally related to a non-nodular taper of the spiralling ribbon. In brief, with the weight present the ribbon is stabilized. Thereby, instead of swinging about vibrational type node points which are desirable in illusions to provide what looks like a series of balls, the ribbon is induced to curve with a modified twisting action that maintains the illusion of a poured stream with the free end weighted enough to provide the illusion while the bottle is being bodily turned about its support enough to swing the weighted end to maintain the illusion of gravity accelerated flow.

The motor 18 is a D.C. motor capable of rotating at a speed of from about 20 to 100 rpm, under load, for best results. Any type of small battery operated motor can be used.

The ribbons 32 are preferably made of cloth, paper or thin flexible plastic. Polyethylene film such as the proprietary product known as MYLAR is a suitable material for the ribbon. When the object 10 to be displayed is an ordinary glass bottle suitable provision is made to affix the combination battery and motor within the neck opening. Where nodulated convolutions or simulated balls 52 or 62 in any given ribbon are desired, the hole 30 may be located centrally at the top of the ribbon shown in FIGS. 3 and 4. Nodulation then is a function of the ribbon length, weight, its flexibility and speed of rotation. Also, the propeller effect of FIG. 1 induced by the ribbon 32 is subject to some variation depending on the flexibility of the ribbon. Aside from the widened top in FIG. 1, a very flexible ribbon will produce less propeller effect and more convolutions, as desired. In the embodiments illustrated in FIGS. 3, 4 and 6, the ribbon 32 is formed of paper. This paper ribbon, flat or folded, is about 0.5 inches wide, 0.05 inches in thickness and 16 inches long. The folding increases its effective weight per inch of length. The ribbon 32*a* is formed of folded paper about 0.05 to 0.015 inches thick and is about 18 inches long when corrugated and suspended under its own weight. Each section has about 20 corrugations therein. The ribbon 32*b* of FIGS. 1 and 5 is formed of MYLAR plastic ribbon and is about 20 inches long, 0.02 to 0.07 inches thick and 0.75 inches wide. The thinner sections 58 and 60 are about 0.01 inches thick and the cross-sectional area indicative of weight per inch of length varies with its width or thickness, or both.

What is claimed is:

1. An animated display device comprising:

an object to be displayed;

overhead suspension means for supporting said object for rotation about a vertical axis;

motor means carried by said object providing a rotatable shaft extending therefrom for rotation about a second axis spaced from and eccentric to said vertical axis; and elongated flexible ribbon means connected to and depending from said shaft for rotation by said motor means, the lateral portions of the ribbon means adjacent the shaft having an effective area diameter and leverage on the shaft against the surrounding air when moving through an arc remote from the vertical axis than when moving nearest the vertical axis for moving the shaft to rotate said object about the vertical axis.

2. The display device defined in claim 1 in which the said rotatable shaft engages the ribbon off center of its center line.

3. The display device defined in claim 1 in which the ribbon tapers from a broad end top to a narrow bottom end.

4. The display device defined in claim 1 in which in a resting planar position the ribbon is arched.

5. The display device defined in claim 1 in which the cross-sectional area of the ribbon diminishes with its length.

6. A display device comprising:

an object depicting a bottle to be displayed;

overhead suspension means for said object including a swivel means for supporting the object for rotation about a vertical axis;

motor means carried by said object providing a rotatable shaft extending therefrom for rotation about another axis inclined to the vertical; and elongated flexible ribbon means affixed by a loose linkage to and rotatable by said shaft to rotate said ribbon and propel the object about the vertical axis the flexibility, length and width of said ribbon being such that upon rotation the ribbon forms a series of convolutions simulating life-like outpouring of liquid, an attractive animated design effect.

7. A display device in accordance with Claim 6 in which:

said suspension means which includes a swivel means is connected to the bottle at a point of balance whereby said bottle assumes a pouring position and said object and said ribbon are rotated about the vertical axis.

8. A display device in accordance with claim 6 in which:

said ribbon is of the same width substantially throughout its length between node points and said convolutions are essentially rounded in configuration.

9. A display device in accordance with claim 6 in which said ribbon includes different colored sections therealong.

10. A display device in accordance with claim 6 in which:

said ribbon includes at least one section intermediate its ends which is of less cross-sectional area to induce convolutions on each side thereof upon rotation.

11. An animated display device comprising:

an object simulating a bottle to be displayed;

overhead suspension means for supporting the bottle, for rotation about a vertical axis, in the air at a point of balance whereby the bottle assumes a pouring position inclined to the horizontal;

motor means carried by said object providing a rotatable drive means including a hook linkage member extending therefrom at the lower end for rotation about an axis likewise inclined to the vertical; and elongated flexible ribbon means affixed at one end to and rotatable by said hook linkage members, the flexibility length and width of said ribbon being such that it provides an attractive animated design effect upon rotation, propels the object about the vertical axis and produces a series of convolutions simulating life-like outpouring of liquid convolutions.

12. The display device defined in claim 11 in which the ribbon tapers from a broad top end to a narrow bottom end and engages said linkage member at the large end.

* * * * *